US010374285B2

(12) United States Patent
Miura

(10) Patent No.: US 10,374,285 B2
(45) Date of Patent: Aug. 6, 2019

(54) ANTENNA AND WIRELESS COMMUNICATION APPARATUS

(71) Applicant: NEC Platforms, Ltd., Kawasaki-shi, Kanagawa (JP)

(72) Inventor: Ken Miura, Kanagawa (JP)

(73) Assignee: NEC PLATFORMS, LTD, Kanagawa (JP)

( * ) Notice: Subject to any disclaimer, the term of this patent is extended or adjusted under 35 U.S.C. 154(b) by 110 days.

(21) Appl. No.: 14/910,348

(22) PCT Filed: Jul. 23, 2014

(86) PCT No.: PCT/JP2014/003870

§ 371 (c)(1),
(2) Date: Feb. 5, 2016

(87) PCT Pub. No.: WO2015/029322

PCT Pub. Date: Mar. 5, 2015

(65) Prior Publication Data

US 2016/0190676 A1 Jun. 30, 2016

(30) Foreign Application Priority Data

Aug. 27, 2013 (JP) ..... 2013-175562

(51) Int. Cl.
*H01Q 1/24* (2006.01)
*H01Q 1/52* (2006.01)
(Continued)

(52) U.S. Cl.
CPC ..... *H01Q 1/243* (2013.01); *H01Q 1/2291* (2013.01); *H01Q 1/38* (2013.01); *H01Q 1/48* (2013.01);
(Continued)

(58) Field of Classification Search
CPC ..... H01Q 1/243; H01Q 1/2291; H01Q 19/00; H01Q 9/0421; H01Q 21/28; H01Q 1/38; H01Q 1/48; H01Q 1/52; H01Q 1/521
See application file for complete search history.

(56) References Cited

U.S. PATENT DOCUMENTS 6,791,498 B2 * 9/2004 Boyle ..... H01Q 1/243 343/702
8,085,202 B2 * 12/2011 Ayatollahi ..... H01Q 1/243 343/700 MS
(Continued)

FOREIGN PATENT DOCUMENTS

JP 2007-097167 A 4/2007
JP 2011-109547 A 6/2011
(Continued)

OTHER PUBLICATIONS

Japanese Office Action for JP Application No. 2013-175562 dated Feb. 23, 2016 with English Translation.
(Continued)

*Primary Examiner* — Dameon E Levi
*Assistant Examiner* — Ab Salam Alkassim, Jr.

(57) ABSTRACT

Provided is an antenna capable of maintaining excellent antenna characteristics even in a case where the antenna cannot be disposed at a desired position or a case where a plurality of antennas are disposed in a single apparatus. This antenna is characterized by being provided with: a printed wiring board; an antenna circuit which is disposed in a predetermined end portion of the printed wiring board and sends and receives radio waves of wavelength λ; and a series resonance circuit disposed at a position in the predetermined end portion of the printed wiring board, the position being separated from the antenna circuit by a distance depending on the wavelength λ. The antenna is also characterized by
(Continued)

being arranged such that the extending direction of the predetermined end portion is perpendicular to the direction of radio wave reception.

17 Claims, 15 Drawing Sheets

(51) Int. Cl.

| | |
|---|---|
| ***H01Q 1/22*** | (2006.01) |
| ***H01Q 1/38*** | (2006.01) |
| ***H01Q 1/48*** | (2006.01) |
| ***H01Q 19/00*** | (2006.01) |
| ***H01Q 21/28*** | (2006.01) |
| ***H01Q 9/04*** | (2006.01) |

(52) U.S. Cl.
CPC ..... *H01Q 1/52* (2013.01); *H01Q 1/521* (2013.01); *H01Q 9/0421* (2013.01); *H01Q 19/00* (2013.01); *H01Q 21/28* (2013.01)

(56) References Cited

U.S. PATENT DOCUMENTS 8,154,467 B2 * 4/2012 Mitsui ..... H01Q 1/243 343/757
8,462,072 B2 * 6/2013 Andrenko ..... H01Q 1/38 343/700 MS
8,502,741 B2 * 8/2013 Lin ..... H01Q 1/243 343/700 MS
8,552,913 B2 * 10/2013 Ayatollahi ..... H01Q 1/243 343/702
8,816,921 B2 * 8/2014 Ayatollahi ..... H01Q 1/243 343/702
8,823,596 B2 * 9/2014 Chen ..... H01Q 13/10 343/702
8,890,763 B2 * 11/2014 Aizawa ..... H01Q 1/36 343/833
9,077,079 B2 * 7/2015 Ke ..... H01Q 1/521
9,077,084 B2 * 7/2015 Li ..... H01Q 5/321
9,124,007 B2 * 9/2015 Yamagajo ..... H01Q 1/36
9,444,129 B2 * 9/2016 Aizawa ..... H01Q 1/243
9,559,414 B2 * 1/2017 Karhuketo ..... H01Q 1/526
9,577,338 B2 * 2/2017 Pan ..... H01Q 5/35
9,627,750 B2 * 4/2017 Suzuki ..... H01Q 1/48
9,685,696 B2 * 6/2017 Uchida ..... H01Q 7/00
9,748,641 B2 * 8/2017 Miura ..... H01Q 1/38
9,786,980 B2 * 10/2017 Ku ..... H01Q 1/243
9,806,786 B2 * 10/2017 Hirabayashi ..... H04B 7/04
10,008,769 B2 * 6/2018 Tian ..... H01Q 1/243
10,148,011 B2 * 12/2018 Wu ..... H01Q 5/35
2004/0246188 A1 * 12/2004 Egashira ..... G06F 1/1616 343/702
2006/0022875 A1 * 2/2006 Pidwerbetsky ..... H01Q 1/243 343/700 MS
2007/0001911 A1 * 1/2007 Fujio ..... H01Q 9/0407 343/700 MS
2007/0069960 A1 * 3/2007 Moon ..... H01Q 1/521 343/700 MS
2008/0088524 A1 * 4/2008 Wang ..... H01Q 13/28 343/909
2010/0156745 A1 * 6/2010 Andrenko ..... H01Q 1/38 343/848
2010/0295739 A1 * 11/2010 Wu ..... H01Q 15/10 343/702
2011/0115687 A1 * 5/2011 Huang ..... H01Q 1/243 343/843
2011/0122040 A1 * 5/2011 Wakabayashi ..... H01Q 1/243 343/833
2011/0148736 A1 * 6/2011 Choi ..... H01Q 1/38 343/893
2012/0212389 A1 * 8/2012 Aizawa ..... H01Q 1/36 343/853
2012/0274536 A1 * 11/2012 Pan ..... H01Q 1/38 343/853
2012/0287012 A1 * 11/2012 Aizawa ..... H01Q 1/243 343/853
2012/0293385 A1 * 11/2012 Liu ..... H01Q 1/38 343/787
2013/0016024 A1 1/2013 Shi et al.
2013/0050057 A1 * 2/2013 Hayashi ..... H01Q 1/38 343/893
2013/0099980 A1 * 4/2013 Hayashi ..... H01Q 1/48 343/700 MS
2013/0162496 A1 * 6/2013 Wakabayashi ..... H01Q 21/00 343/853
2014/0085158 A1 * 3/2014 Wong ..... H01Q 1/48 343/841
2014/0139392 A1 * 5/2014 Wong ..... H01Q 1/523 343/841
2014/0139399 A1 * 5/2014 Miyake ..... H01Q 1/521 343/893
2014/0203993 A1 * 7/2014 Toyao ..... H01Q 13/10 343/867
2014/0266974 A1 * 9/2014 Sharawi ..... H01Q 21/28 343/893
2014/0313089 A1 * 10/2014 Wu ..... H01Q 1/243 343/745
2015/0009093 A1 * 1/2015 Taura ..... H01Q 1/38 343/893
2015/0263418 A1 * 9/2015 Suzuki ..... H01Q 1/48 343/848
2015/0288071 A1 * 10/2015 Toyao ..... H01Q 1/48 343/700 MS
2015/0364817 A1 * 12/2015 Ma ..... H01Q 1/521 343/810
2015/0380810 A1 * 12/2015 Miura ..... H01Q 1/38 343/700 MS
2016/0013546 A1 * 1/2016 Toyao ..... H01Q 1/243 343/904
2016/0072194 A1 * 3/2016 Yoshida ..... H01Q 1/521 343/852
2017/0244162 A1 * 8/2017 Toyao ..... H01Q 1/48
2017/0292920 A1 * 10/2017 Torun ..... G01N 22/00
2017/0317419 A1 * 11/2017 Wu ..... H01Q 5/30
2018/0123261 A1 * 5/2018 Sano ..... H01Q 1/523
2018/0284034 A1 * 10/2018 Torun ..... H01Q 9/0464

FOREIGN PATENT DOCUMENTS

JP 2012-199808 A 10/2012
JP 2012-244188 A 12/2012
WO 2013/027824 A1 2/2013
WO WO-2013027824 A1 * 2/2013 ..... H01Q 13/10

OTHER PUBLICATIONS

International Search Report for PCT Application No. PCT/JP2014/003870, dated Oct. 28, 2014.
English translation of Written opinion for PCT Application No. PCT/JP2014/003870.

* cited by examiner

ANTENNA GAIN OF WIRELESS ROUTER 100 PROVIDED WITH DUMMY SRR 500

ANTENNA GAIN OF WIRELESS ROUTER 900 PROVIDED WITH NO DUMMY SRR

ISOLATION OF WIRELESS ROUTER 100B PROVIDED WITH DUMMY SRR 500B

ISOLATION OF WIRELESS ROUTER PROVIDED WITH NO DUMMY SRR

ISOLATION OF WIRELESS ROUTER 100C PROVIDED WITH DUMMY SRR 500C

ISOLATION OF WIRELESS ROUTER PROVIDED WITH NO DUMMY SRR

ANTENNA AND WIRELESS COMMUNICATION APPARATUS

This application is a National Stage Entry of PCT/JP2014/003870 filed on Jul. 23, 2014 which claims priority from Japanese Patent Application 2013-175562 filed on Aug. 27, 2013 the contents of all of which are incorporated herein by reference, in their entirety.

TECHNICAL FIELD

The present invention relates to an antenna and a wireless communication apparatus, and in particular, relates to an antenna and a wireless communication apparatus which are used for wireless communication with a communication apparatus.

BACKGROUND ART

With the wide-spread use of wireless communication, it has become common that a single apparatus can deal with a plurality of wireless systems. In such a single apparatus, it is desirable to dispose an antenna at an optimum position within the apparatus, in order to enable the apparatus to deal with various wireless systems at any time with no restriction in terms of time or place. Also for the purpose of dealing with a plurality of wireless systems, there is a case of disposing a plurality of antennas within a single apparatus.

On the other hand, on portable terminals exemplified by a cellular phone, a smart phone or the like, size reduction is demanded in addition to increase in functionality. Accordingly, in the apparatus design, it is required to dispose a large number of components within a terminal. While it is required to dispose an antenna at an optimum position for the purpose of dealing with a plurality of wireless systems, there is a case where the antenna cannot be disposed at an optimum position as a result of trade-off with other components.

In this respect, there has been a proposal of adopting a split ring resonator (SRR) antenna which can maintain an excellent characteristic regardless of its mounting position as long as the position is in the periphery of a multi-layered printed board. Such an SRR antenna is disclosed in Patent Literature 1 (PTL1), for example.

The antenna of Patent Literature 1 (PTL1) is shown in FIG. 13. In the antenna 900 shown in FIG. 13, conductor layers 930 and 940 are arranged on the top and the bottom, respectively, of a dielectric layer 920 of a multi-layered printed board 910. Then, by forming openings 931 and 941 and slits 932 and 942 in end regions of the respective conductor layers 930 and 940, split ring parts 951 and 952 are formed. Further, by arranging, within the dielectric layer 920, conductive vias 953 electrically connecting the split ring parts 951 and 952 with each other and a power feeder 954 connected to one of the conductive vias 953, an SRR antenna 950 is formed.

CITATION LIST

Patent Literature

[PTL1] International Publication WO2013/027824

SUMMARY OF INVENTION

Technical Problem

The SRR antenna functions as an antenna with an excellent characteristic when it is mounted in the periphery of the multi-layered printed board, regardless of the specific mounting position in the periphery. However, when it is desired to achieve antenna gain in a specific direction, the mounting position of the SRR antenna cannot be optional. For example, when the SRR antenna cannot be disposed at the vertical center as a result of trade-off with other components, its horizontal antenna gain may be decreased. Further, when a plurality of SRR antennas are disposed in a single apparatus, the plurality of SRR antennas interfere with one another, which results in degradation in the isolation.

The present invention has been made in view of the above-described problem, and accordingly, its objective is to provide an antenna and a wireless communication apparatus which both can maintain an excellent antenna characteristic even when an antenna cannot be disposed at a desired position or when a plurality of antennas are disposed in a single apparatus.

Solution to Problem

In order to achieve the above-mentioned object, an antenna of the present invention includes: a printed wiring board; an antenna circuit which is disposed in a predetermined end portion of the printed wiring board and sends and receives radio waves of wavelength λ; and a series resonance circuit disposed at a position in the predetermined end portion of the printed wiring board, the position being separated from the antenna circuit by a distance depending on the wavelength λ, wherein the antenna being arranged such that the extending direction of the predetermined end portion becomes perpendicular to the direction of receiving the radio waves.

In order to achieve the above-mentioned object, a wireless communication apparatus of the present invention includes: a wireless IC; and the antenna mentioned above which sends radio waves of wavelength λ received from an external apparatus to the wireless IC and sends radio waves of wavelength λ received from the wireless IC to the external apparatus, wherein the wireless communication apparatus being arranged to face the external apparatus in an XY plane.

Advantageous Effects of Invention

According to the aspect of the present invention described above, an excellent antenna characteristic can be maintained even when an antenna cannot be disposed at a desired position or when a plurality of antennas are disposed in a single apparatus.

DESCRIPTION OF EMBODIMENTS (First Exemplary Embodiment)

Figure 1A:
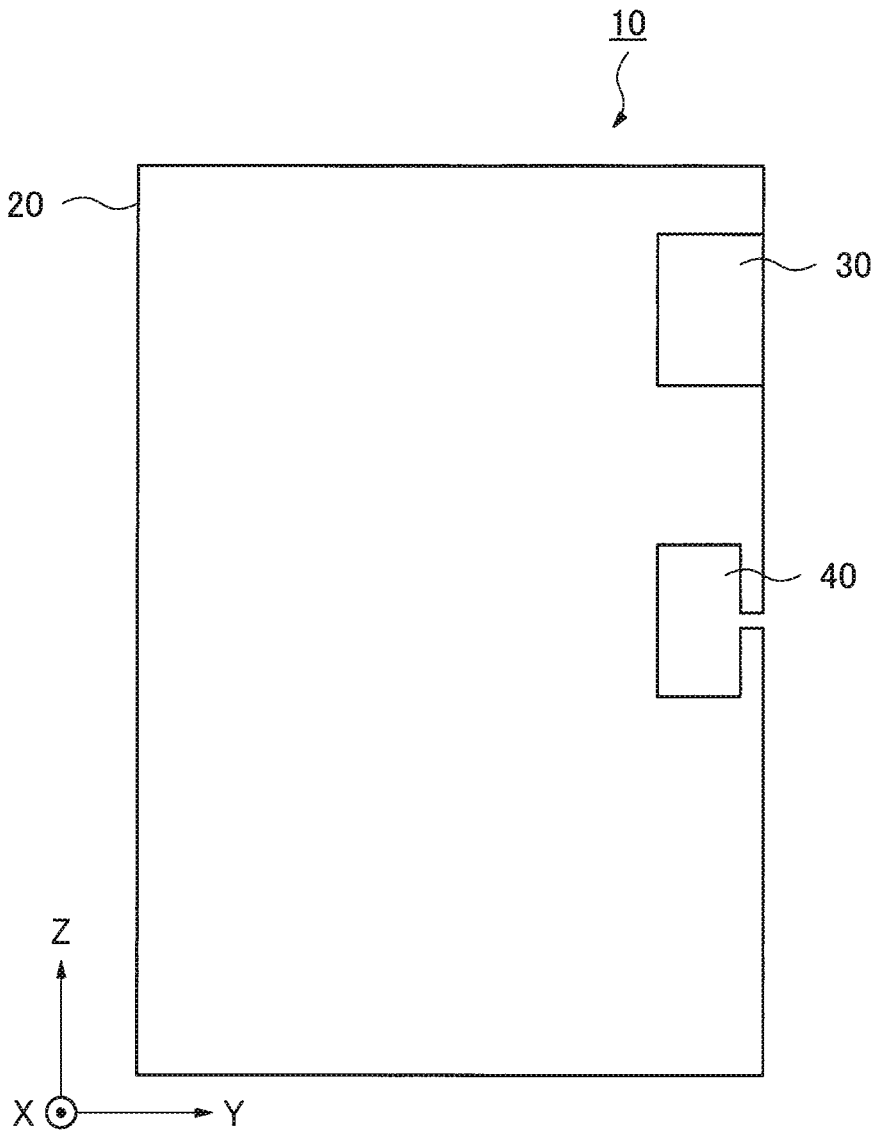
FIG. 1A is a front view of an antenna 10 according to a first exemplary embodiment.

A first exemplary embodiment of the present invention will be described below. FIG. 1A shows a front view of an antenna according to the present exemplary embodiment. In FIG. 1A, the antenna 10 is composed of a printed wiring board 20, an antenna circuit 30 and a series resonance circuit 40. Here, the height, width and thickness directions of the antenna 10 are defined as the Z, Y and X directions, respectively.

The antenna 10 according to the present exemplary embodiment is arranged in a wireless communication apparatus performing wireless communication with an external apparatus, or the like. The antenna 10 is arranged such that the antenna 10 faces the external apparatus, which is a wireless communication partner, in an XY plane.

On the printed wiring board 20, a large number of other electrical components not illustrated in the drawing are mounted, in addition to the antenna circuit 30 and the series resonance circuit 40. When the antenna 10 is arranged on an XY plane, the printed wiring board 20 is arranged in a YZ plane, which is perpendicular to the XY plane.

The antenna circuit 30 is disposed in an end portion, of the printed wiring board 20, extending in the Z direction. In order to avoid mutual cancellation between a radio-frequency current flowing in the +Z direction and that flowing in the −Z direction, both generated in the antenna circuit 30, it is desirable that the antenna circuit 30 is disposed at the center in the Z direction of the printed wiring board 20. When the radio-frequency current flowing in the +Z direction and that flowing in the −Z direction cancel out each other, there occurs degradation in antenna gain in the XY directions along which the wireless communication apparatus faces an external apparatus. In the present exemplary embodiment, as a result of trade-off with other electrical components, the antenna circuit 30 is disposed at a position other than that at the center in the Z direction of the printed wiring board 20.

The series resonance circuit 40 is disposed at a position located a predetermined distance apart from the antenna circuit 30, within the end portion, of the printed wiring board 20, where the antenna circuit 30 is already disposed. As the series resonance circuit 40, for example, a split ring resonator, which is fabricated into an approximately C-shaped form by cutting part of a ring-shaped metal film on the top surface of the printed wiring board 20, may be adopted. The split ring resonator functions as an LC series resonance circuit constituted by a capacitance created at the cut portion and an inductance generated by current flowing in a ring-shaped manner around the C shape, and accordingly absorbs current of a target frequency.

Being disposed in the end portion extending in the Z direction, of the printed wiring board 20, where the antenna circuit 30 is disposed, the series resonance circuit 40 configured as described above absorbs a radio-frequency current flowing in the +Z direction and that flowing in the −Z direction, both generated at the antenna circuit 30. As a result, mutual cancellation between the radio-frequency current flowing in the +Z direction and that flowing in the −Z direction can be reduced, and accordingly, antenna gain in the XY directions is kept excellent.

Thus, in the antenna 10 according to the present exemplary embodiment, by the effect of disposing the series resonance circuit 40 in the end portion, of the printed wiring board 20, where the antenna circuit 30 is disposed, an excellent antenna characteristic can be maintained even when the antenna circuit 30 cannot be disposed at the center in the Z direction of the printed wiring board 20.

Figure 1B:
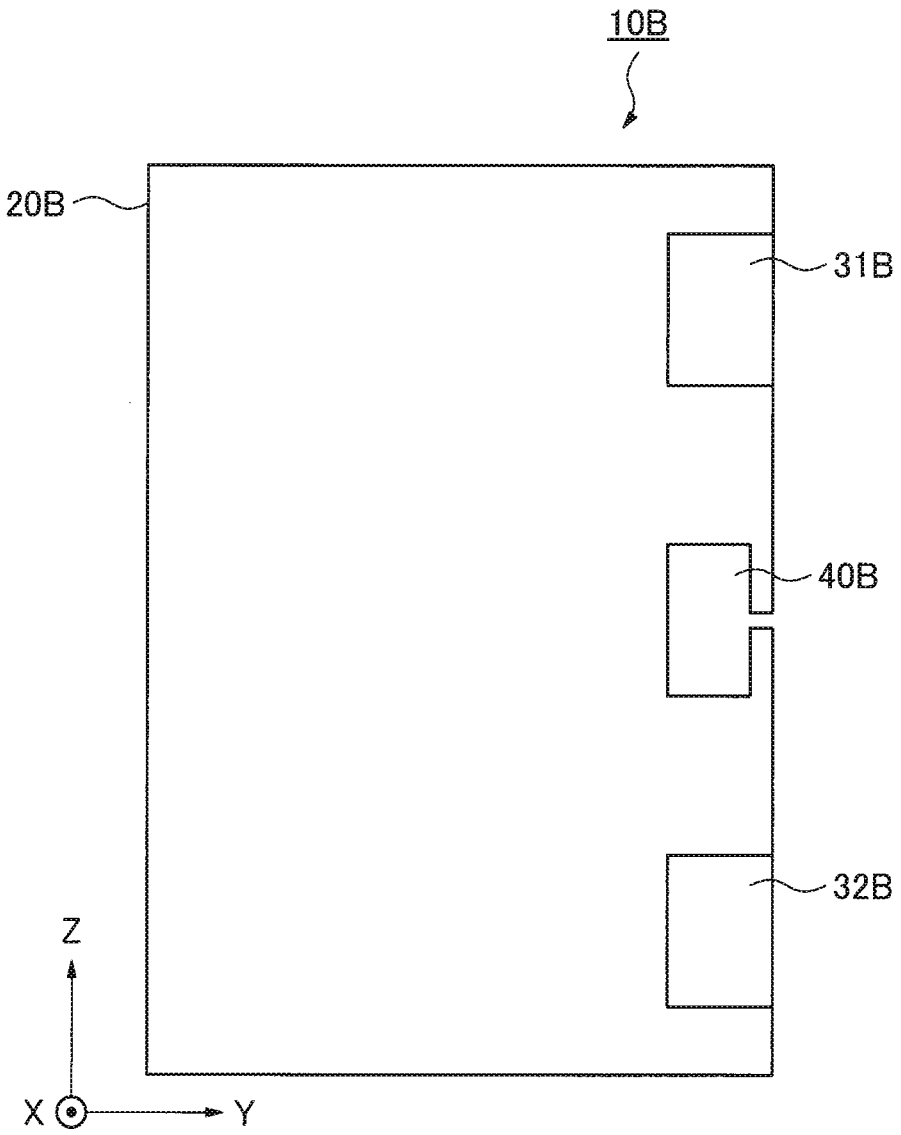
FIG. 1B is a front view of an antenna 10B according to the first exemplary embodiment.

Further, also when a plurality of antenna circuits are disposed on a printed wiring board, for the purpose of dealing with a plurality of wireless systems, an excellent antenna characteristic can be maintained by disposing the series resonance circuit in the end portion, of the printed wiring board, where the antenna circuits are disposed FIG. 1B shows a front view of an antenna having a plurality of antenna circuits disposed on a printed wiring board. In FIG. 1B, the antenna 10B is composed of a printed wiring board 20B, a first antenna circuit 31B, a second antenna circuit 32B and a series resonance circuit 40B.

As the first and second antenna circuits 31B and 32B, for example, a split ring resonator antenna or an inverted L-shaped antenna may be adopted. As the series resonance circuit 40B, the series resonance circuit 40 described above with reference to FIG. 1A may be adopted.

As shown in FIG. 1B, the first antenna circuit 31B, the series resonance circuit 40B and the second antenna circuit 32B are disposed in this order in an end portion extending in the Z direction, of the printed wiring board 20B. When the two antenna circuits 31B and 32B are disposed in a predetermined end portion of the printed wiring board 20B, there flows on the printed wiring board 20B a radio-frequency current $\alpha 1$ flowing in the +Z direction and a radio-frequency current $\beta 1$ flowing in the −Z direction, both emitted from the first antenna circuit 31B, and also a radio-frequency current $\alpha 2$ flowing in the +Z direction and a radio-frequency current $\beta 2$ flowing in the −Z direction, both emitted from the second antenna circuit 32B.

Then, by disposing the series resonance circuit 40B between the first and second antenna circuits 31B and 32B, the radio-frequency currents α1, α2, β1 and β2, emitted from the antenna circuits 31B and 32B, are absorbed by the series resonance circuit 40B, and accordingly, mutual cancellation among the radio-frequency currents α1, α2, β1 and β2 can be suppressed. As a result, even in the case where the plurality of antenna circuits 31B and 32B are disposed on the printed wiring board 20B, the antenna 10B according to the present exemplary embodiment can maintain an excellent antenna characteristic.

(Second Exemplary Embodiment)

Figure 2:
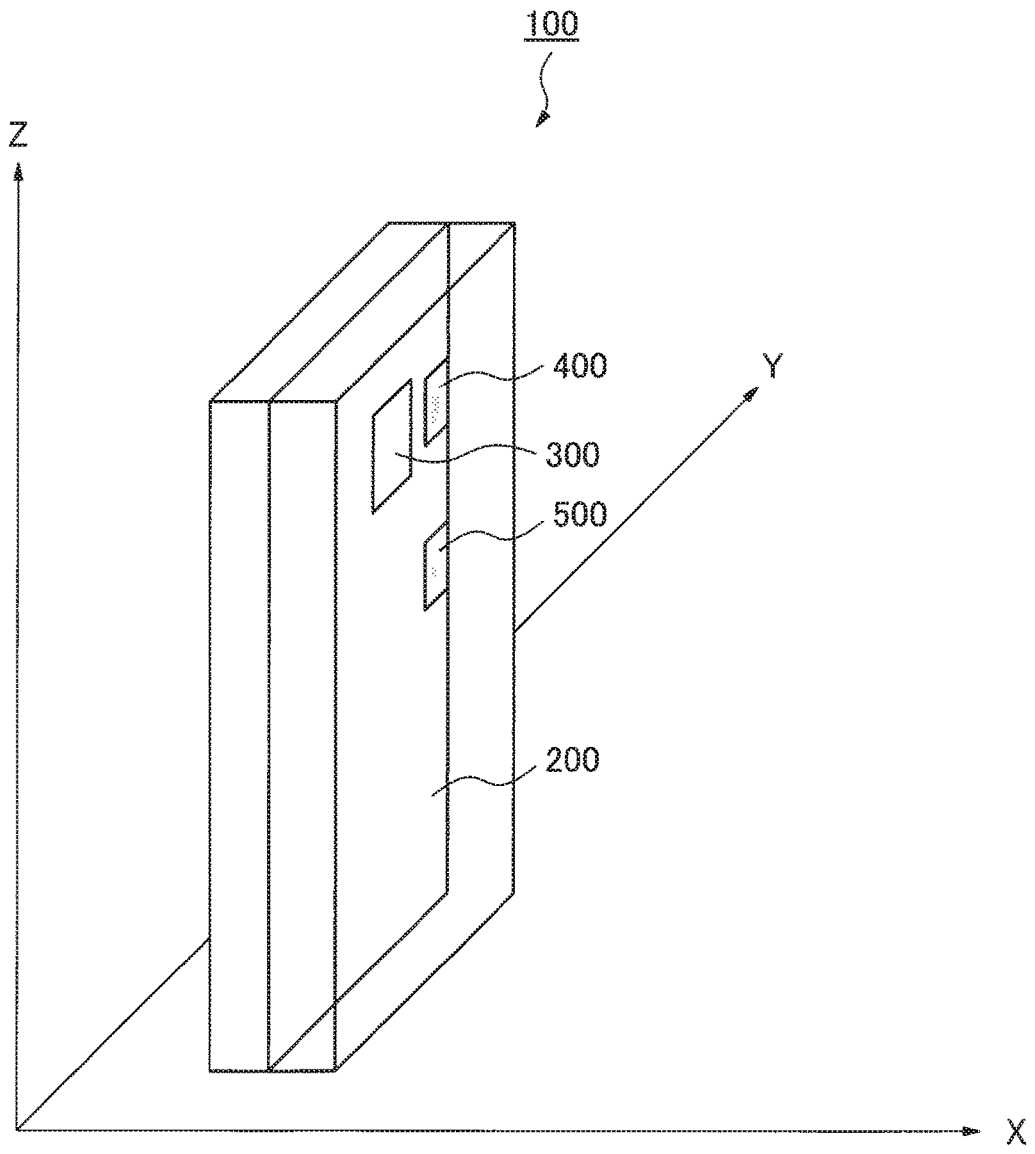
FIG. 2 is a diagram where a wireless router 100 according to a second exemplary embodiment is installed in a room.

A second exemplary embodiment will be described below. In the present exemplary embodiment, a wireless router is adopted as a wireless communication apparatus. FIG. 2 shows a state where the wireless router according to the present exemplary embodiment is installed in a room. A wireless router 100 according to the present exemplary embodiment is usually installed in a direction to set a printed wiring board 200 arranged in its inside to be perpendicular to the floor surface of the room. Then, when the wireless router 100 according to the present exemplary embodiment is installed in the room, a wireless IC 300 comes to be located in the upper right region of the printed wiring board 200, an SRR (Split Ring Resonator) antenna 400 does in the vicinity of the wireless IC 300, and a dummy SRR 500 does beneath the SRR antenna 400. Hereinafter, a plane parallel to the floor surface is defined as an XY plane, and a plane parallel to the rear surface of the wireless router 100 is defined as a YZ plane.

When the wireless router 100 is installed on the floor surface (the XY plane) in the room as in FIG. 2, the wireless router 100 and an opposing apparatus, such as a smart phone or a tablet, face each other in the XY directions. Because the wireless router 100 sends and receives radio waves to and from the opposing apparatus, its antenna gain in the XY directions is most important.

Figure 3:
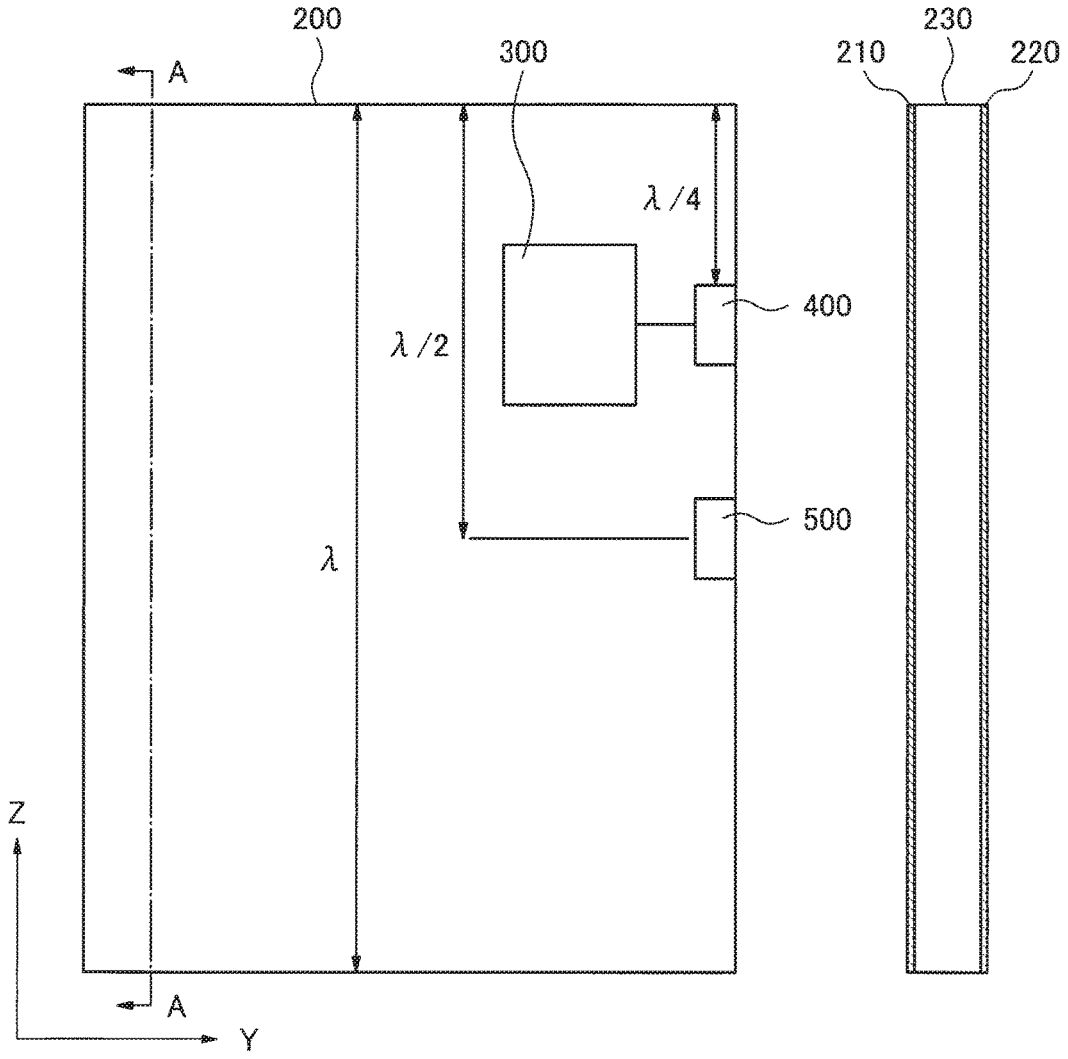
FIG. 3 shows a front view of a printed board 200 according to the second exemplary embodiment and its cross-sectional view taken on line A-A.

When the wireless router 100 is thus installed in the room, the printed wiring board 200 becomes perpendicular to the floor surface. On the printed wiring board 200, a large number of electrical components not illustrated in the drawing are mounted, in addition to the wireless IC 300, the SRR antenna 400 and the dummy SRR 500. FIG. 3 shows a front view of the printed wiring board 200 and its cross-sectional view taken on line A-A. As shown in FIG. 3, the printed wiring board 200 is constructed by arranging a first conductor layer 210 on the front surface of a dielectric 230 and a second conductor layer 220 on the back surface. Here, the printed wiring board 200 according to the present exemplary embodiment is formed to have a length in the Z direction approximately equal to the wavelength λ of a radio wave to be dealt with by the wireless IC 300.

The wireless IC 300 is disposed on the front surface of the printed wiring board 200, and sends and receives radio waves to and from the opposing apparatus, such as a smart phone or a tablet, which is not illustrated in the drawing, via the SRR antenna 400. In the present exemplary embodiment, the wireless IC 300 is disposed at a position approximately λ/4 beneath the top end of the printed wiring board 200, as a result of trade-off with other electrical components.

The SRR antenna 400 is disposed in an end portion of the printed wiring board 200, and sends radio waves received from the opposing apparatus to the wireless IC 300, and sends radio waves received from the wireless IC 300 to the opposing apparatus. The SRR antenna 400 is disposed in the very vicinity of input-output terminals of the wireless IC 300, in order to minimize transmission loss of the radio waves. Because the wireless IC 300 is disposed at a position approximately λ/4 beneath the top end of the printed wiring board 200, the SRR antenna 400 of the present exemplary embodiment is disposed at a position in an end portion, which also is λ/4 beneath the top end of the printed wiring board 200.

The dummy SRR 500 is disposed λ/4 beneath the SRR antenna 400, that is, at the center in the Z direction of the printed wiring board 200 (at λ/2 height). Located at the position λ/4 beneath the SRR antenna 400, the dummy SRR 500 absorbs radio-frequency current emitted from the SRR antenna 400.

Figure 4A:
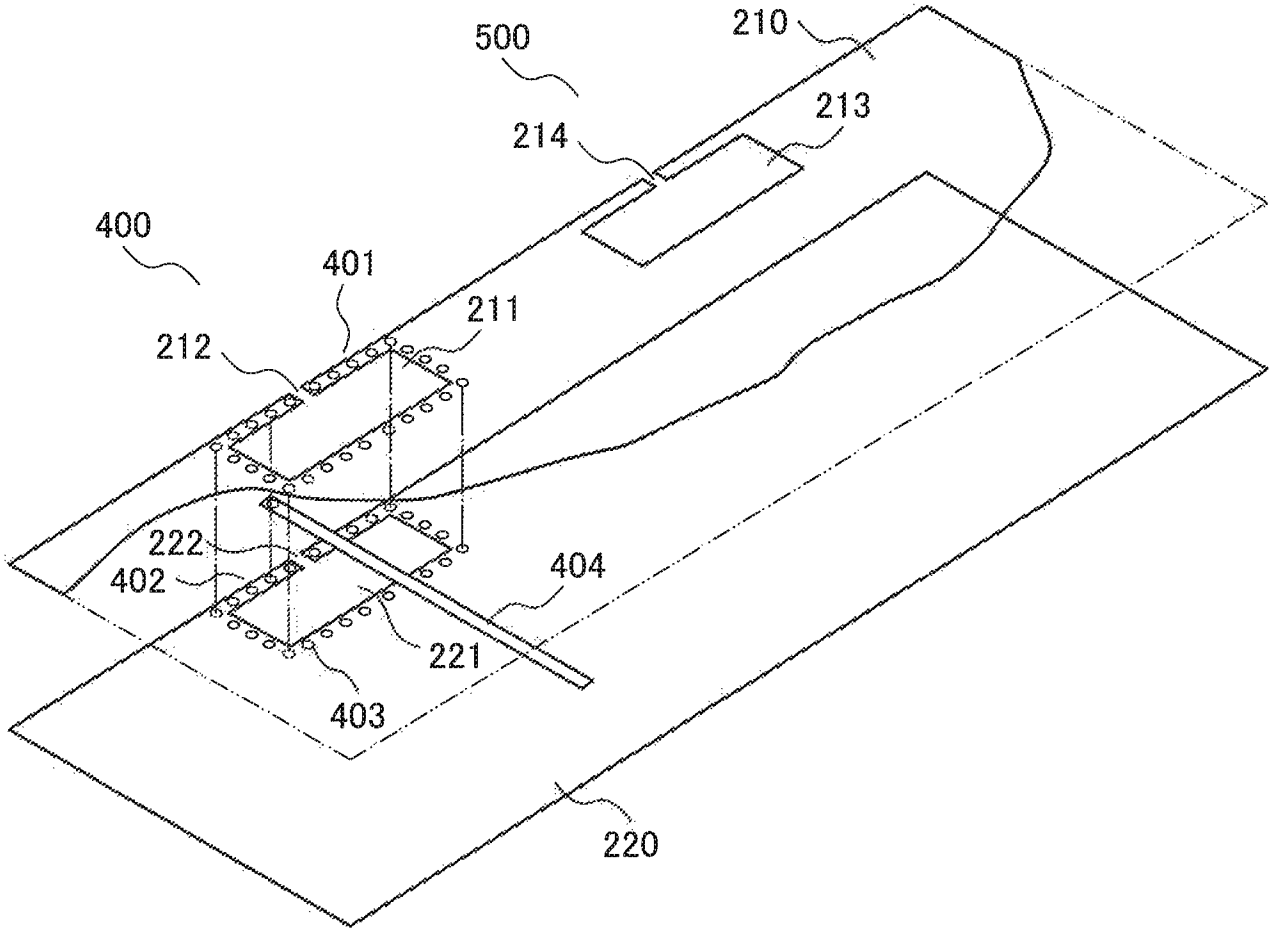
FIG. 4A is an exploded perspective view of an SRR antenna 400 and a dummy SRR 500 according to the second exemplary embodiment.

Detail description of the SRR antenna 400 and the dummy SRR 500 will be given below. Of the SRR antenna 400 and the dummy SRR 500, an exploded perspective view is shown in FIG. 4A, and a cross-sectional view in FIG. 4B. A functional configuration diagram of the SRR antenna 400 is shown in FIG. 5A, and that of the dummy SRR 500 is shown in FIG. 5B.

Figure 13:
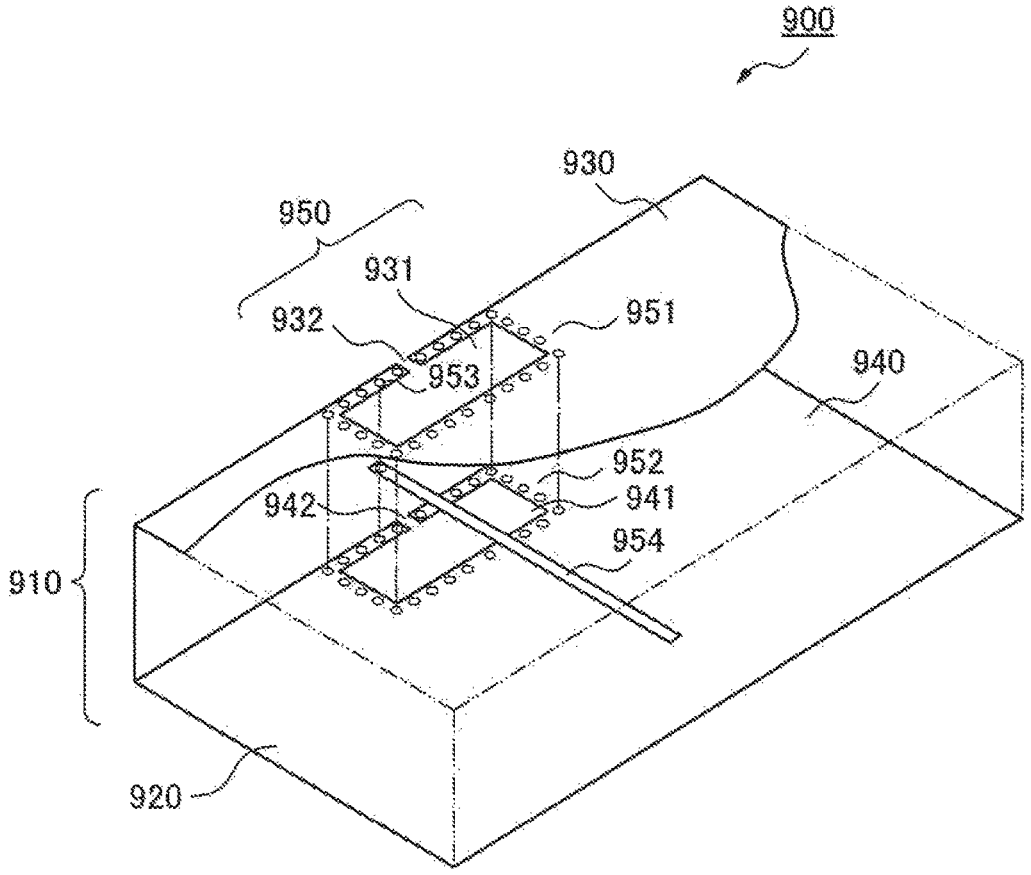
FIG. 13 is an exploded perspective view of an antenna 900 according to Patent Literature 1 (PTL1).

As shown in FIG. 4A, the SRR antenna 400 is configured similarly to the SRR antenna 950 of FIG. 13 already described in the Background Art, and specifically, it is composed of a first split ring part 401, a second split ring part 402, a plurality of conductive vias 403 and a power feeder 404.

The first split ring part 401 is fabricated by forming a first opening 211 in an end region of the first conductor layer 210 near the wireless IC 300 and further forming a first slit 212 which splits a belt-like region formed between the first opening 211 and the very end of the first conductor layer 210.

The second split ring part 402 is similarly fabricated by forming a second opening 221 in the second conductor layer 220 at a position facing the first opening 211, and further forming a second slit 222 at a position facing the first slit 212.

As shown in FIG. 4A, the plurality of conductive vias 403 are disposed around the openings 211 and 221. The conductive vias 403 are fabricated, for example, by piercing through the dielectric 230 and the second conductor layer 220 by drilling and then plating their insides.

The power feeder 404 is a lengthy conductive layer disposed within the dielectric 230. One end of the power feeder 404 is connected to one of the conductive vias 403, and the other end is connected to an RF (Radio Frequency) circuit not illustrated in the drawing at an end portion on the opposite side of the printed wiring board 200.

In the present exemplary embodiment, the first split ring part 401, the second split ring part 402 and the power feeder 404 are each fabricated using a copper foil. The first split ring part 401, the second split ring part 402 and the power feeder 404 may be fabricated using any other conductive materials.

In the SRR antenna 400 configured as described above, an LC series resonance circuit is constituted by a capacitance created by the first and second slits 212 and 222 and an inductance generated by current flowing in a ring-shaped manner around the first opening 211 and that around the second opening 221.

That is, a split ring resonator is constituted by the left side region indicated by a dotted line in FIG. 5A. When a radio-frequency signal is fed at a power feeding point of the split ring resonator from an RF circuit, via the power feeder 404, the SRR antenna 400 functions as an antenna around its resonant frequency. Here, the resonant frequency can be lowered by increasing the sizes of the first and second openings 211 and 221, or decreasing the widths of the first and second slits 212 and 222.

The right side region indicated by an alternate long and short dash line in FIG. 5A constitutes a loop for impedance matching. By the loop for impedance matching, impedance matching between the SRR antenna 400 and the input-output terminals of the wireless IC 300 is performed.

As shown in FIG. 4A, the dummy SRR 500 is fabricated by forming a third opening 213 in an end region of the first conductor layer 210 and further forming a third slit 214 which splits a belt-like region formed between the third opening 213 and the very end of the first conductor layer 210. In the dummy SRR 500, an LC series resonance circuit is constituted, as shown in FIG. 5B, by a capacitance created at the third slit 214 and an inductance generated by current flowing in a ring-shaped manner around the third opening 213. The dummy SRR 500 functions as a split ring resonator and accordingly absorbs current of a desired frequency.

Here, a discussion will be given of an antenna characteristic in a case of applying the wireless router 100 comprising the SRR antenna 400 and the dummy SRR 500, which are constituted as above, to WiFi (Wireless Fidelity, frequency: 2.4 GHz, $\lambda$=125 mm). Hereinafter, a description will be given of a case where the wireless router 100 has the configuration shown in FIG. 3. That is, the printed wiring board 200 is formed to have a length in the Z direction of 125 mm, which is equal to the wavelength $\lambda$ of a radio wave used in WiFi, the SRR antenna 400 is disposed at a position in the right-hand side region of the printed wiring board 200, which is $\lambda/4$ beneath the top end, and the dummy SRR 500 is disposed at a position of $\lambda/2$ height (at the center in the vertical direction).

For comparison, also discussed is an antenna characteristic in a case of applying to WiFi the wireless router 900 of FIG. 13 already described in the Background Art, which has no dummy SRR disposed in it.

Figure 6A:
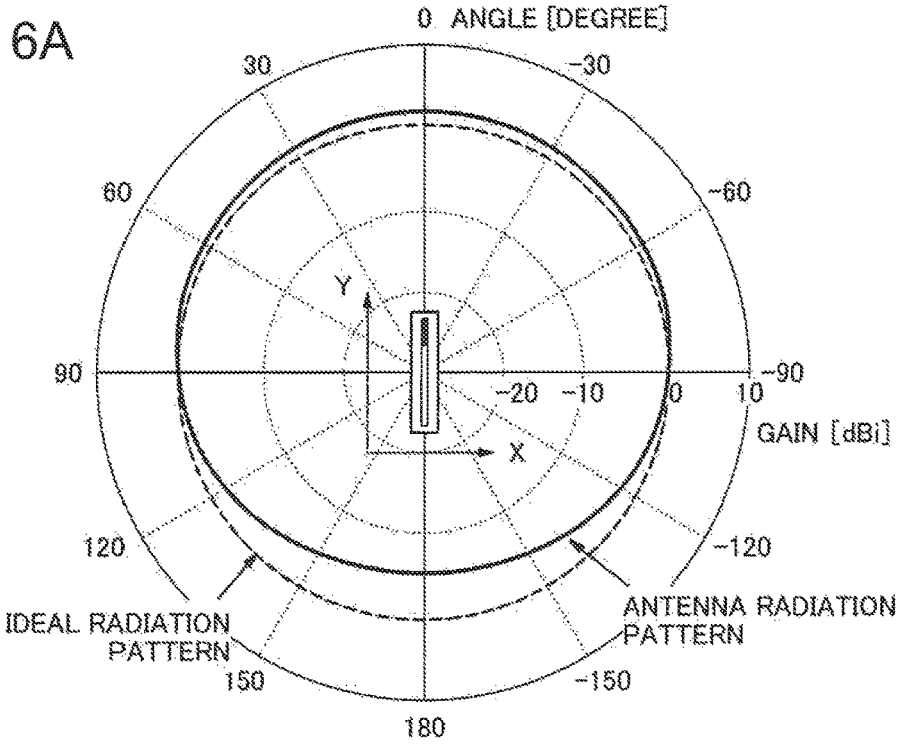
FIG. 6A shows antenna gain of the wireless router 100 according to the second exemplary embodiment.
Figure 6B:
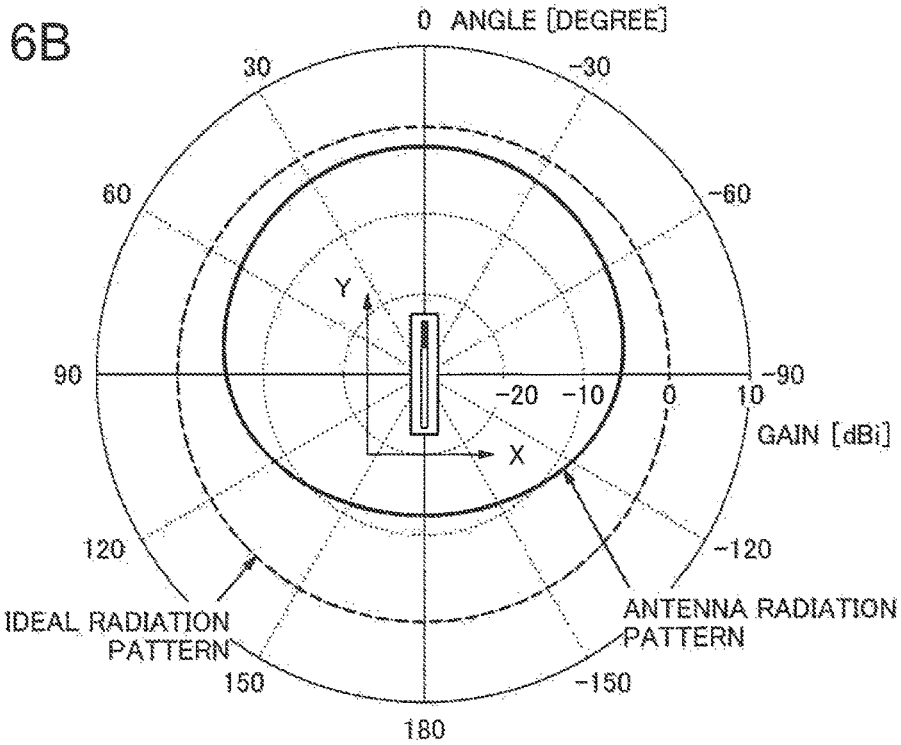
FIG. 6B shows antenna gain of a wireless router 900 according to the background art.

FIG. 6A shows antenna gain in the case of applying the wireless router 100 provided with the dummy SRR 500 to WiFi. FIG. 6B shows antenna gain in the case of applying the wireless router 900 provided with no dummy SRR to WiFi. Further, an ideal radiation pattern of antenna gain is shown by a dotted line in both of FIGS. 6A and 6B.

As shown in FIG. 6B, the antenna gain of the wireless router 900 provided with no dummy SRR is low in the entire XY directions and, in particular, remarkably low on the side where no SRR antenna is disposed. On the other hand, as shown in FIG. 6A, the wireless router 100 according to the present exemplary embodiment shows antenna gain almost coincident with the ideal radiation pattern, as a result of the disposing the dummy SRR 500 $\lambda/4$ beneath the SRR antenna 400.

This is because the disposing the dummy SRR 500 $\lambda/4$ beneath the SRR antenna 400 results in that radio-frequency currents of mutually different directions, both emitted from the SRR antenna 400, are absorbed by the dummy SRR 500. Here, the radio-frequency current is the very radio-frequency AC current for radiating radio waves, which is the one alternating 2.4 billion times a second in the case of WiFi (frequency: 2.4 GHz).

Figure 7A:
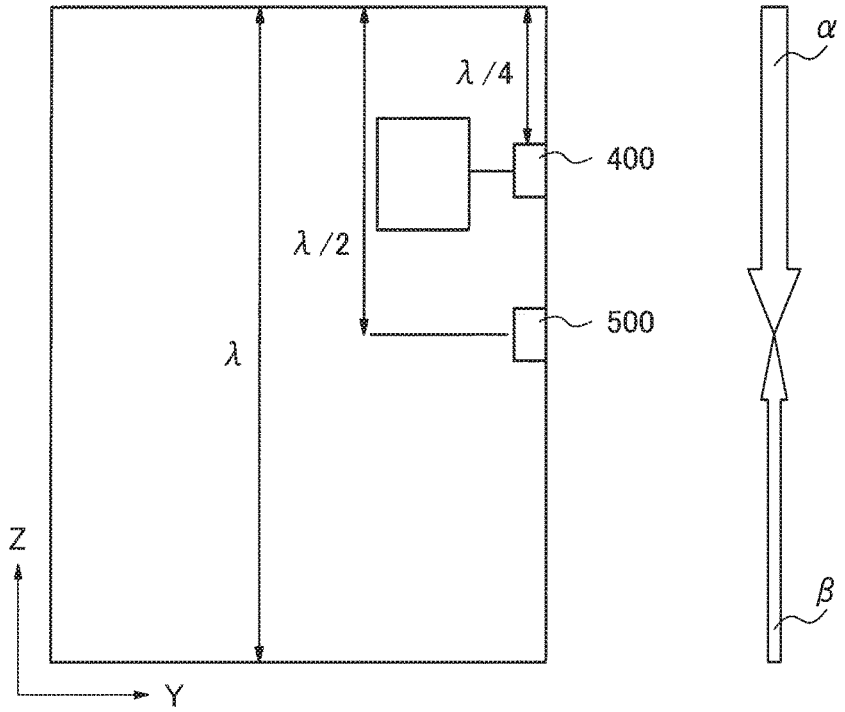
FIG. 7A shows a state of radio-frequency current in the wireless router 100 according to the second exemplary embodiment.
Figure 7B:
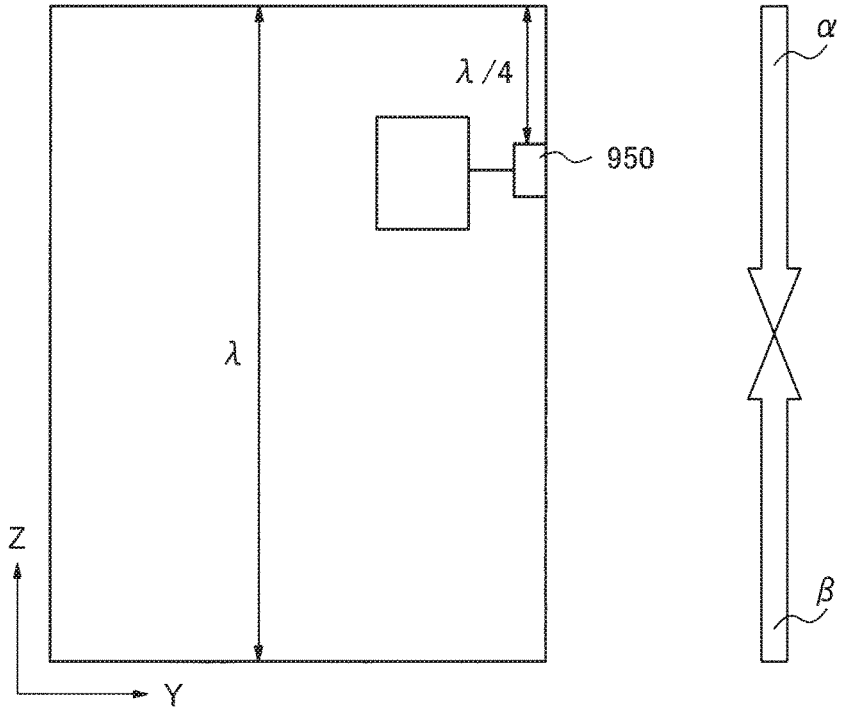
FIG. 7B shows a state of radio-frequency current in the wireless router 900 according to the background art.

FIG. 7A shows a state of radio-frequency currents in the case of applying the wireless router 100 according to the present exemplary embodiment to WiFi. FIG. 7B shows a state of radio-frequency currents in the case of applying the wireless router 900 provided with no dummy SRR to WiFi.

As shown in FIG. 7A, in the case of having the dummy SRR 500 disposed at a position $\lambda/4$ beneath the SRR antenna 400, radio-frequency currents of mutually different directions, both emitted from the SRR antenna 400, are absorbed by the dummy SRR 500, and accordingly, mutual cancellation between them is reduced. As a result, decrease in the antenna gain in the XY directions is suppressed.

On the other hand, as shown in FIG. 7B, in the case of the wireless router 900 provided with no dummy SRR, a radio-frequency current $\alpha$ flowing downward from a top end portion and a radio-frequency current $\beta$ flowing upward from a bottom end portion, both emitted from the SRR antenna 950, cancel out each other. In that case, the function as a split ring resonator is degraded, and the antenna gain in the XY directions is accordingly decreased. Here, even in the case of having no dummy SRR, if it is possible to dispose the SRR antenna 950 at the central height in the end portion of the printed wiring board 200, the mutual cancellation between the radio-frequency currents $\alpha$ and $\beta$ does not occur, and accordingly, there occurs no decrease in the antenna gain.

As described above, in the wireless router 100 according to the present exemplary embodiment, the dummy SRR 500 is disposed at a position $\lambda/4$ beneath the SRR antenna 400 when the SRR antenna 400 cannot be disposed at the central height in an end portion of the printed wiring board 200. As a result, two radio-frequency currents of mutually different directions, both emitted from the SRR antenna 400, are absorbed by the dummy SRR 500, and accordingly, mutual cancellation between the radio-frequency currents is reduced. Accordingly, even when the SRR antenna 400 cannot be disposed at the central height on the printed wiring board 200 as a result of trade-off with other components, antenna gain in directions parallel to the floor surface can be kept excellent.

While, in the present exemplary embodiment, the printed wiring board 200 is formed to have a length in the Z direction approximately equal to the wavelength $\lambda$ of a radio wave to be dealt with by the wireless IC 300, it may be formed to be longer than $\lambda$ in the Z direction. In that case, it is appropriate to dispose dummy SRRs 500 both $\lambda/4$ above and $\lambda/4$ beneath the SRR antenna 400. By thus disposing the dummy SRRs 500 each $\lambda/4$ apart from the SRR antenna 400, unnecessary radio-frequency currents are absorbed at the dummy SRRs 500, and the antenna gain in the XY directions is accordingly kept excellent.

(Third Exemplary Embodiment)

A third exemplary embodiment will be described below. A wireless router according to the present exemplary embodiment is compatible with MIMO (Multiple-input and Multiple-output) technology. MIMO technology is wireless communication technology which deals with a wide communication band by combining together a plurality of antennas, and is adopted in communication methods such as WiFi and LTE (Long Term Evolution). The wireless router 100B according to the present exemplary embodiment has two SRR antennas disposed within it, so as to be compatible with MIMO technology.

Figure 8:
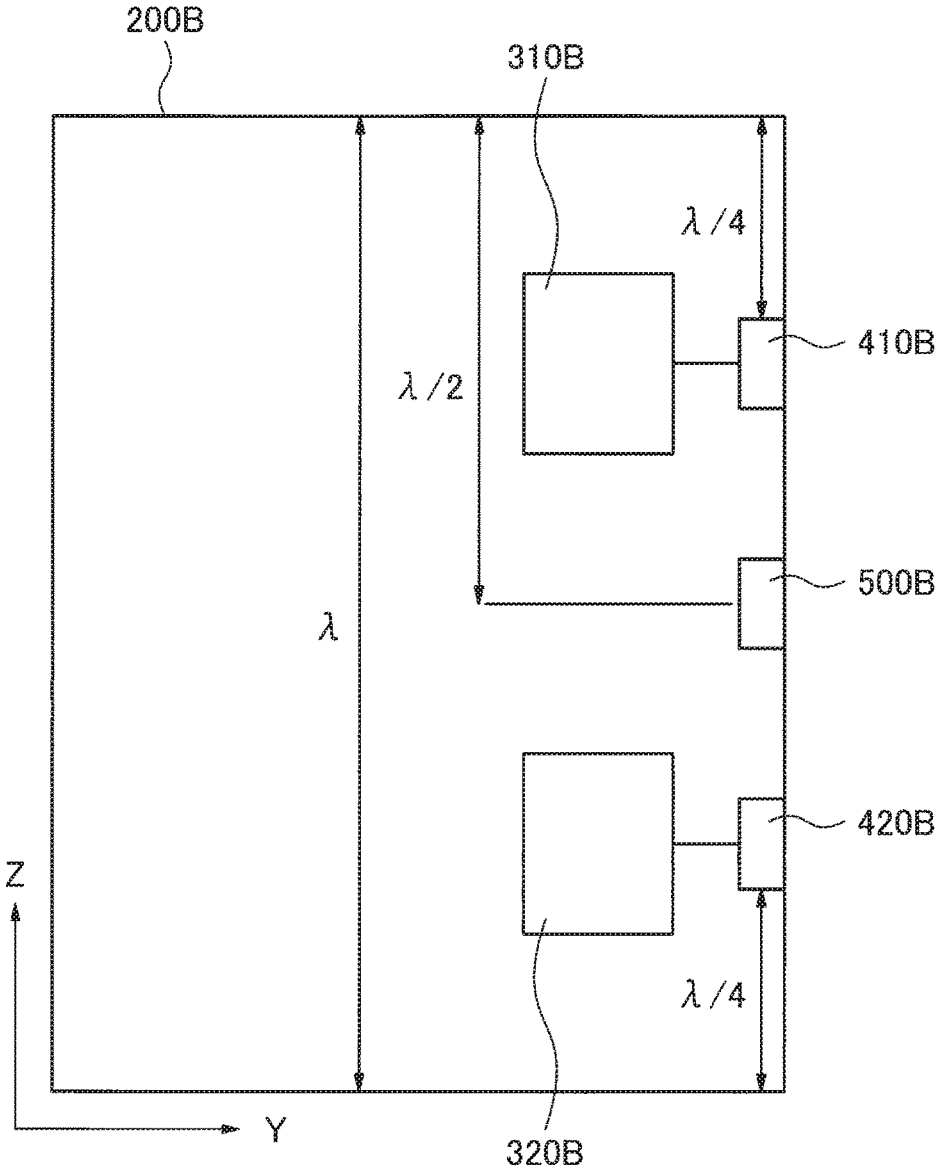
FIG. 8 is a front view of a printed board 200B according to a third exemplary embodiment.

FIG. 8 shows a front view of a printed wiring board arranged in the wireless router 100B according to the present exemplary embodiment. As shown in FIG. 8, the printed wiring board 200B is formed to have a length $\lambda$ in the Z direction. Then, a wireless IC 310B is disposed at a position $\lambda/4$ beneath the top end of the printed wiring board 200B, and a wireless IC 320B is disposed at a position $\lambda/4$ above the bottom end of the printed wiring board 200B.

Further, an SRR antenna 410B is disposed in an end region, of the printed wiring board 200B, which is at the same height as the wireless IC 310B is, and an SRR antenna 420B is disposed in an end region, of the printed wiring board 200B, which is at the same height as the wireless IC 320B is. A dummy SRR 500B is further disposed in an end region, of the printed wiring board 200B, which is at the center in the Z direction (at λ/2 height).

Figure 4B:
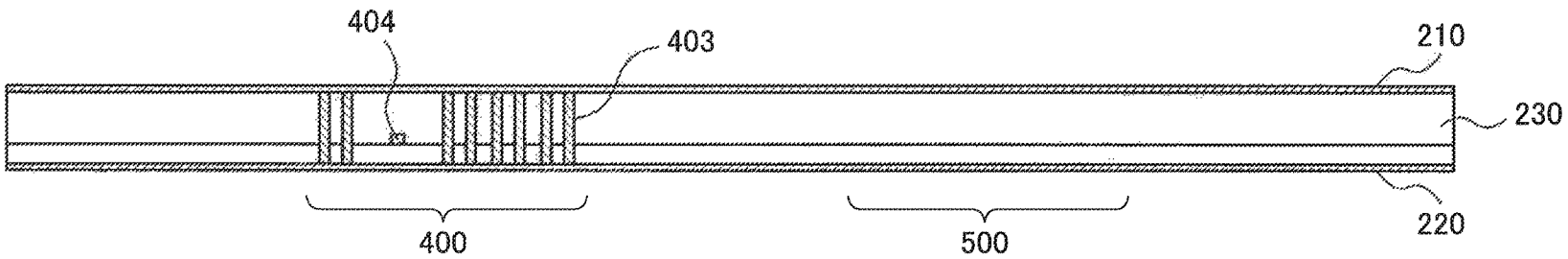
FIG. 4B is a cross-sectional view of the SRR antenna 400 and dummy SRR 500 according to the second exemplary embodiment.
Figure 5A:
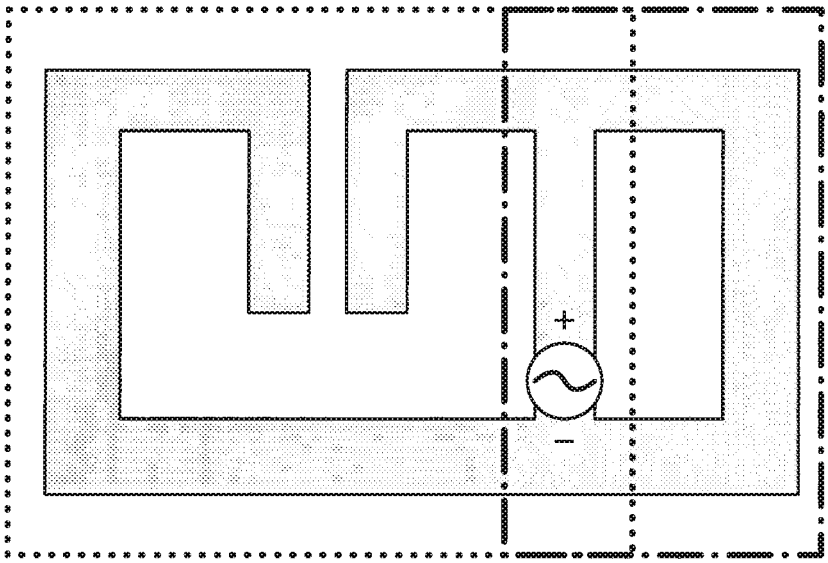
FIG. 5A is a functional configuration diagram of the SRR antenna 400 according to the second exemplary embodiment.
Figure 5B:
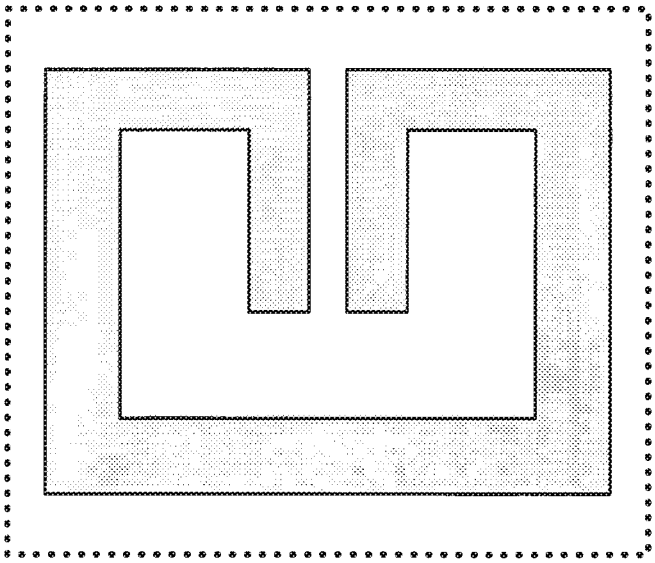
FIG. 5B is a functional configuration diagram of the dummy SRR 500 according to the second exemplary embodiment.

The SRR antennas 410B and 420B are configured similarly to the SRR antenna 400 of FIGS. 4A and 4B described in the second exemplary embodiment. On the other hand, the dummy SRR 500B is configured similarly to the dummy SRR 500 of FIG. 4A described in the second exemplary embodiment. That is, by configuring the SRR antennas 410B and 420B each in the form of a split ring resonator and supplying radio-wave signals at their power feed points, the SRR antennas 410B and 420B each function as an antenna. The dummy SRR 500B is configured in the form of a split ring resonator and absorbs radio-frequency currents emitted from the SRR antennas 410B and 420B.

Figure 9A:
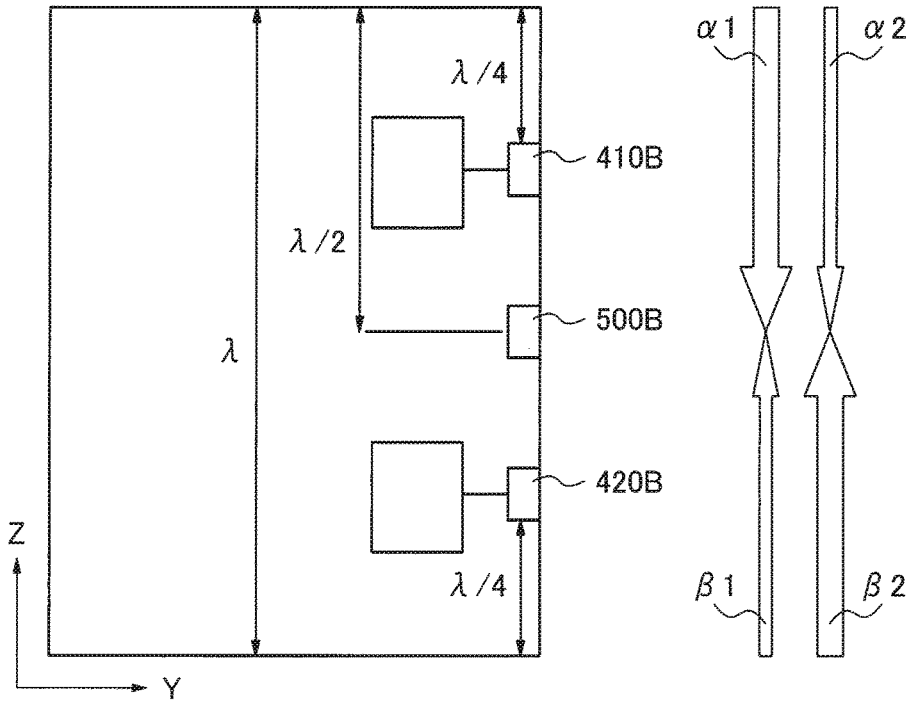
FIG. 9A shows a state of radio-frequency current in a case where a dummy SRR 500B is disposed.
Figure 9B:
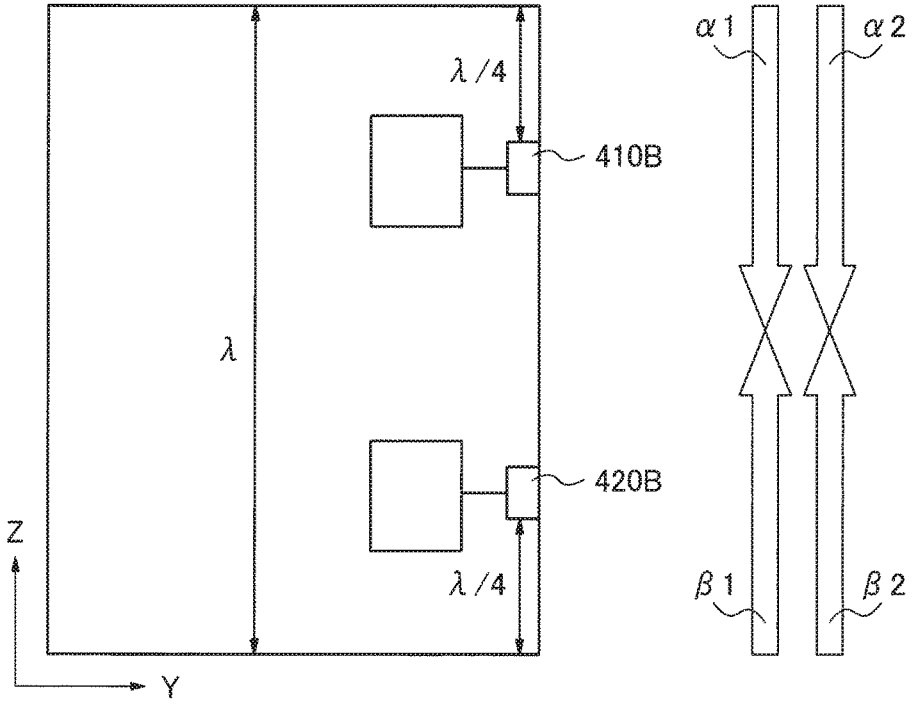
FIG. 9B shows a state of radio-frequency current in a case where the dummy SRR 500B is not disposed.
Figure 10A:
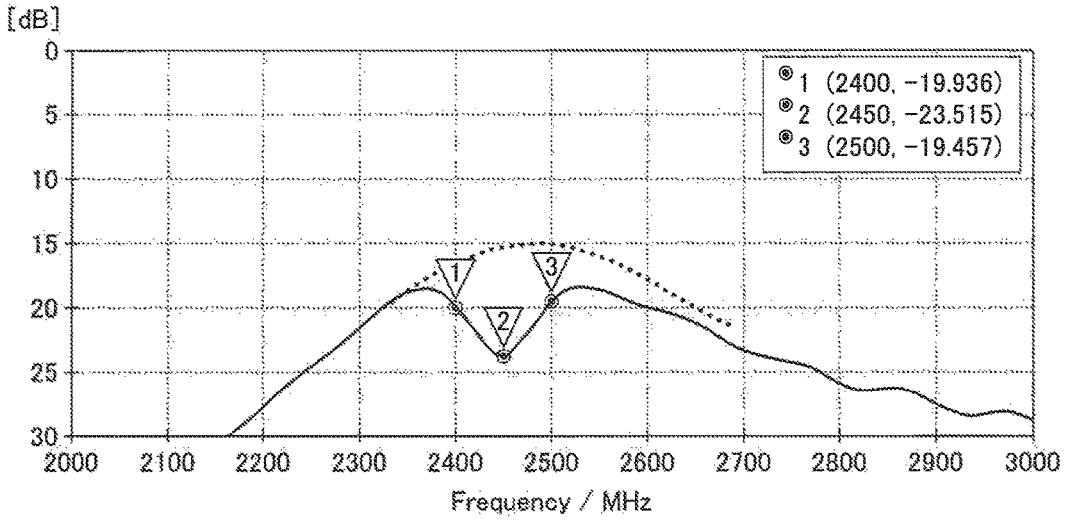
FIG. 10A is an isolation graph for the case where the dummy SRR 500B is disposed.
Figure 10B:
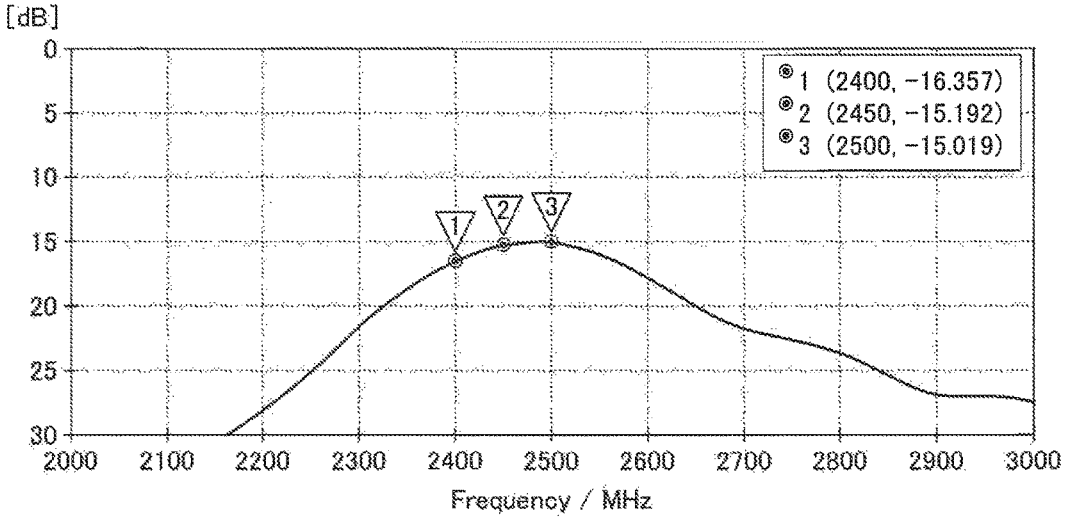
FIG. 10B is an isolation graph for the case where the dummy SRR 500B is not disposed.

With respect to the wireless router provided with the two SRR antennas, FIG. 9A shows a state of radio-frequency currents in a case of disposing the dummy SRR 500B, and FIG. 9B shows that in a case of disposing no dummy SRR. With respect to a case where the wireless router provided with the two SRR antennas is applied to WiFi, FIG. 10A shows an isolation graph in a case of disposing the dummy SRR 500B, and FIG. 10B shows that in a case of disposing no dummy SRR. Here, radio waves of 2.4 GHz frequency are used in WiFi.

Here, the isolation is a degree indicating interference among a plurality of antennas. A state of small isolation means a state where interference among a plurality of antennas is large and the antennas are adversely affecting one another in antenna characteristics. In FIGS. 10A and 10B, the X axis represents frequency (MHz), and the Y axis does isolation (dB). In FIGS. 10A and 10B, a lower point on the Y axis indicates a more improved isolation.

As shown in FIG. 9B, in the case of disposing no dummy SRR, there occurs interference and resultant mutual cancellation among a radio-frequency current α1 flowing downward from the top end portion and a radio-frequency current β1 flowing upward from the bottom end portion, both emitted from the SRR antenna 410B, and a radio-frequency current α2 flowing downward from the top end portion and a radio-frequency current β2 flowing upward from the bottom end portion, both emitted from the SRR antenna 420B. In that case, as shown in FIG. 10B, enough isolation is not achieved in the target frequency range from 2400 to 2500 (MHz).

On the other hand, as shown in FIG. 9A, by disposing the dummy SRR 500B, for example, the radio-frequency current β1, emitted from the SRR antenna 410B and flowing upward from the bottom end portion, and the radio-frequency current α2, emitted from the SRR antenna 420B and flowing downward from the top end portion, are absorbed by the dummy SRR 500B, and the interference is accordingly reduced. As a result, as shown in FIG. 10A, the isolation is improved by several dB in the target frequency range from 2400 to 2500 (MHz).

While, in the present exemplary embodiment, the printed wiring board 200B is formed to have a length λ in the Z direction, and the SRR antenna 410B, the dummy SRR 500B and the SRR antenna 420B are disposed in this order at λ/4 intervals along the Z direction, it is not the only limited case. For example, when the length of the printed wiring board 200B is larger than λ in the Z direction, degradation in the isolation can be suppressed by disposing the SRR antennas and the dummy SRR alternately at λ/4 intervals.

(Modified Example of Third Exemplary Embodiment)

Figure 11:
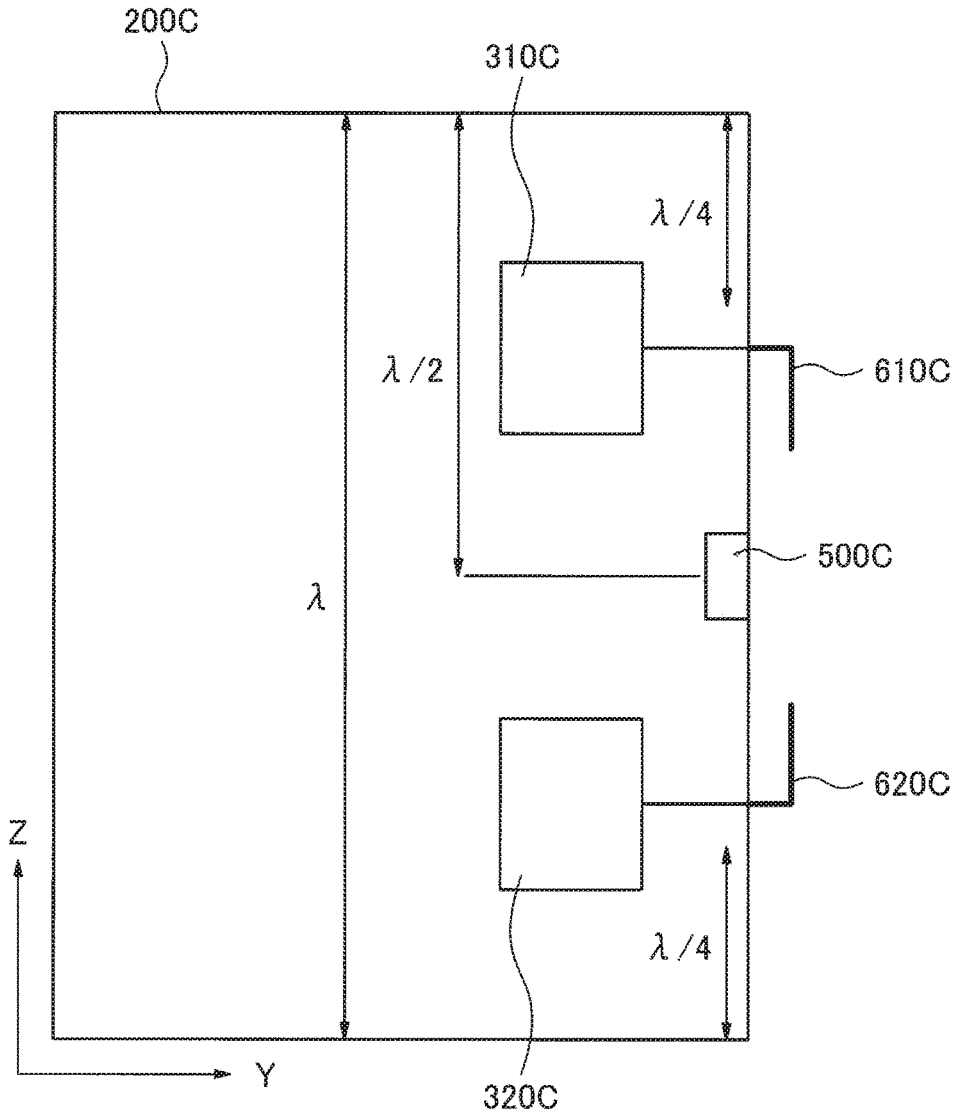
FIG. 11 is a front view of a printed board 200C according to a modified example of the third exemplary embodiment.

A modified example of the third exemplary embodiment will be described below. While, the SRR antennas 410B and 420B are adopted as the antennas in the third exemplary embodiment, an inverted L-shaped antenna, for example, also may be adopted. In the present exemplary embodiment, two inverted L-shaped antennas are disposed in the wireless router 100C. FIG. 11 shows a front view of a printed wiring board of an antenna according to the present exemplary embodiment.

As shown in FIG. 11, the printed wiring board 200C is formed to have a length λ in the Z direction, where a wireless IC 310C is disposed at a position λ/4 beneath the top end of the printed wiring board 200C, and a wireless IC 320C is disposed at a position λ/4 above the bottom end of the printed wiring board 200C. Then, an inverted L-shaped antenna 610C is disposed in an end region, of the printed wiring board 200C, which is at the same height as the wireless IC 310C is, and an inverted L-shaped antenna 620C is disposed in an end region, of the printed wiring board 200C, which is at the same height as the wireless IC 320C is. A dummy SRR 500C is further disposed in an end region, of the printed wiring board 200C, which is at the center in the Z direction (λ/2 height).

Figure 12A:
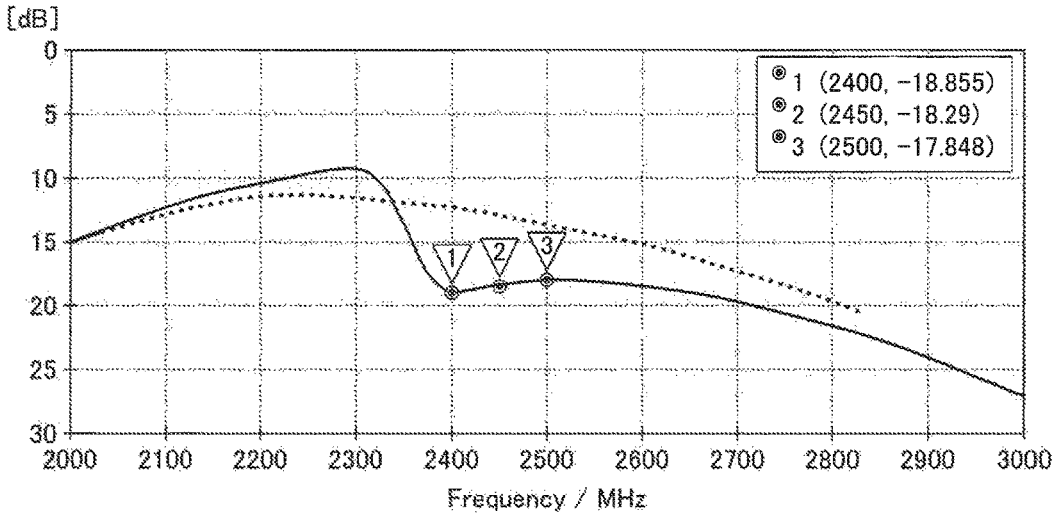
FIG. 12A is an isolation graph for a case where a dummy SRR 500C is disposed.
Figure 12B:
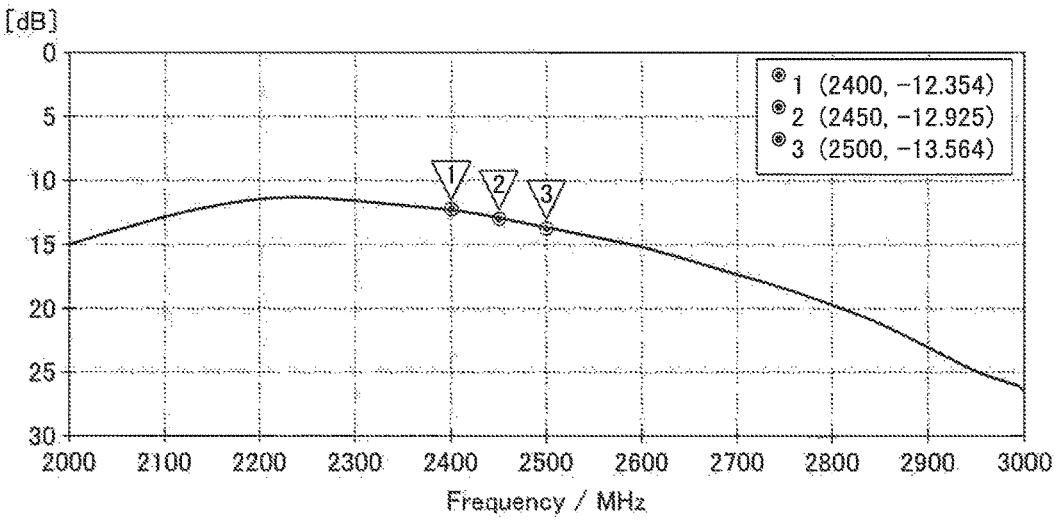
FIG. 12B is an isolation graph for a case where the dummy SRR 500C is not disposed.

With respect to a case where the inverted L-shaped antennas 610C and 620C are adopted, FIG. 12A shows an isolation graph in a case of disposing the dummy SRR 500C, and FIG. 12B shows that in a case of disposing no dummy SRR.

Also in the case of adopting the inverted L-shaped antennas, by disposing the dummy SRR 500C at a position λ/4 apart from both of the inverted L-shaped antennas 610C and 620C, a radio-frequency current emitted from the inverted L-shaped antenna 610C and flowing upward from the bottom end portion and a radio-frequency current emitted from the inverted L-shaped antennas 620C and flowing downward from the top end portion are absorbed by the dummy SRR 500B, for example, and the interference is accordingly reduced. As a result, as shown in FIG. 12A, the isolation is improved by several dB in the target frequency range from 2400 to 2500 (MHz).

The present invention is not limited to the above-described exemplary embodiments, and embraces any changes in design or the like which are within a range not departing from the spirit of the present invention.

The present invention is based upon and claims the benefit of priority from Japanese Patent Application No. 2013-175562, filed on Aug. 27, 2013, the disclosure of which is incorporated herein in its entirety by reference.

INDUSTRIAL APPLICABILITY

The antennas according to the present invention can be applied to a wireless apparatus compatible with communication methods such as WiFi and LTE, and the like.

REFERENCE SIGNS LIST

10, 10B antenna
20, 20B printed wiring board
30, 31B, 32B antenna circuit
40, 40B series resonance circuit
100, 100B, 100C wireless router
200, 200B, 200C printed board
210, 220 conductor layer
211, 213, 221 opening
212, 214, 222 slit
230 dielectric
300, 310B, 320B wireless IC
400, 410B, 420B SRR antenna

401 first split ring part
402 second split ring part
403 conductive via
404 power feeder
500, 500B, 500C dummy SRR
610C, 620C inverted L-shaped antenna
900 antenna
910 multi-layered printed wiring board
920 dielectric layer
930, 940 conductor layer
931, 941 opening
932, 942 slit
950 SRR antenna
951, 952 split ring part
953 conductive via
954 power feeder

What is claimed is:

1. An antenna comprising: a printed wiring board having a conductive layer having a primary portion and an end portion disposed at an end of the primary portion, the primary portion and the end portion conductively connected within the conductive layer; an antenna circuit which is disposed in the end portion and which sends and receives radio waves of wavelength λ; a series resonance circuit disposed at a position in the predetermined end portion of the conductive layer in the printed wiring board, the position being separated from the antenna circuit by a distance depending on the wavelength λ, the series resonance circuit and the antenna circuit cooperatively suppressing current flowing in the conductive layer, the antenna being arranged such that the extending direction of the predetermined end portion becomes perpendicular to the direction of receiving the radio waves, wherein the predetermined end portion of the printed wiring board is formed to have a length approximately equal to the wavelength λ; the antenna circuit is disposed in the predetermined end portion and at approximately λ/4 height from an installation surface thereof; and the series resonance circuit is disposed in the predetermined end portion and at approximately λ/2 height from the installation surface thereof.

2. The antenna according to claim 1, wherein
the series resonance circuit is a split ring resonator fabricated into an approximately C-shaped form by cutting part of a metal ring.

3. The antenna according to claim 1, wherein
the printed wiring board comprises a dielectric layer, a first conductive layer arranged on one surface of the dielectric layer and a second conductive layer arranged on the other surface of the dielectric layer, and
the antenna circuit is a split ring resonator antenna composed of:
a first split ring part having an approximately C-shaped form, which is formed in the first conductive layer;
a second split ring part having an approximately C-shaped form, which is formed in the second conductive layer and faces the first split ring part;
a conductive via which electrically connects the first split ring part with the second split ring part; and
a power feeder with its one end connected to the conductive vias and other end being a point from which power is fed.

4. The antenna according to claim 1, further comprising a second antenna circuit disposed on the opposite side to the antenna circuit with respect to the series resonance circuit, in the predetermined end portion of the printed wiring board.

5. The antenna according to claim 4, wherein
the second antenna circuit is disposed in the predetermined end portion of the printed wiring board and at approximately (¾)λ height from the installation surface thereof.

6. The antenna according to claim 4, wherein
the second antenna circuit is a split ring resonator antenna.

7. The antenna according to claim 1, further comprising
a second antenna circuit disposed on the opposite side to the antenna circuit with respect to the series resonance circuit, in the predetermined end portion of the printed wiring board, wherein
the antenna circuit and the second antenna circuit are inverted L-shaped antennas.

8. The antenna according to claim 7, wherein
the second antenna circuit is disposed in the predetermined end portion of the printed wiring board and at approximately (¾)λ height from the installation surface thereof.

9. A wireless communication apparatus comprising:
a wireless IC; and
an antenna according to claim 1 which sends radio waves of wavelength λ received from an external apparatus to the wireless IC and sends radio waves of wavelength λ received from the wireless IC to the external apparatus,
the wireless communication apparatus being arranged to face the external apparatus in an XY plane.

10. The antenna according to claim 1, further comprising a second antenna circuit disposed on the opposite side to the antenna circuit with respect to the series resonance circuit, in the predetermined end portion of the printed wiring board.

11. The antenna according to claim 10, wherein the second antenna circuit is disposed in the predetermined end portion of the printed wiring board and at approximately (¾)λ, height from the installation surface thereof.

12. The antenna according to claim 1, further comprising a second antenna circuit disposed on the opposite side to the antenna circuit with respect to the series resonance circuit, in the predetermined end portion of the printed wiring board, wherein the antenna circuit and the second antenna circuit are inverted L-shaped antennas.

13. The antenna according to claim 12, wherein
the second antenna circuit is disposed in the predetermined end portion of the printed wiring board and at approximately (¾)λ height from the installation surface thereof.

14. The antenna according to claim 1, wherein the antenna circuit is disposed in the predetermined end portion and at a position approximately λ/4 beneath a top end of the printed wiring board; and the series resonance circuit is disposed in the predetermined end portion and at a position approximately λ/2 beneath the top end of the printed wiring board.

15. The antenna according to claim 1, wherein the antenna circuit is disposed in the predetermined end portion and at a position approximately λ/4 above a bottom end of the printed wiring board; and the series resonance circuit is disposed in the predetermined end portion and at approximately λ/2 above the bottom end of the printed wiring board.

16. The antenna according to claim 5, wherein
the antenna circuit is disposed in the predetermined end portion and at approximately λ/4 above a bottom end of the printed wiring board; and
the second antenna circuit is disposed in the predetermined end portion and at approximately λ/4 beneath a top end of the printed wiring board.

17. The antenna according to claim 5, wherein the antenna circuit is disposed in the predetermined end portion and at approximately λ/4 beneath a top end of the printed wiring board; and the second antenna circuit is disposed in the predetermined end portion and at approximately λ/4 above a bottom end of the printed wiring board.

* * * * *